US010710767B2

(12) United States Patent
Merzeau

(10) Patent No.: US 10,710,767 B2
(45) Date of Patent: Jul. 14, 2020

(54) CARTON AND BLANK THEREFOR

(71) Applicant: WestRock Packaging Systems, LLC, Atlanta, GA (US)

(72) Inventor: Julien D. Merzeau, Châteauroux (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 15/954,048

(22) Filed: Apr. 16, 2018

(65) Prior Publication Data

US 2018/0297744 A1 Oct. 18, 2018

Related U.S. Application Data

(60) Provisional application No. 62/486,716, filed on Apr. 18, 2017.

(51) Int. Cl.
*B65D 5/42* (2006.01)
*B65D 71/36* (2006.01)
(Continued)

(52) U.S. Cl.
CPC ..... *B65D 5/4204* (2013.01); *B65D 5/0254* (2013.01); *B65D 5/48014* (2013.01); *B65D 5/5007* (2013.01); *B65D 71/36* (2013.01); *B65D 2303/00* (2013.01); *B65D 2571/0029* (2013.01); *B65D 2571/0045* (2013.01); *B65D 2571/0066* (2013.01); *B65D 2571/0087* (2013.01); *B65D 2571/00141* (2013.01);
(Continued)

(58) Field of Classification Search
CPC .... B65D 5/4204; B65D 5/725; B65D 5/0066; B65D 71/20; B65D 71/22; B65D 2571/0066; B65D 2571/2571; B65D 77/02
USPC ..... 229/162.1–162.7, 103, 103.2; 206/427, 206/194, 168, 429, 199
See application file for complete search history.

(56) References Cited

U.S. PATENT DOCUMENTS 2,358,523 A * 9/1944 McKinley ..... B65D 5/001 206/194
3,256,983 A * 6/1966 Lech ..... B65D 5/4204 206/139
(Continued)

FOREIGN PATENT DOCUMENTS

WO WO 02/34639 A1 5/2002
WO WO 2008/036754 A2 3/2008
(Continued)

*Primary Examiner* — Nathan J Newhouse
*Assistant Examiner* — Phillip D Schmidt
(74) *Attorney, Agent, or Firm* — WestRock Intellectual Property Group

(57) ABSTRACT

Aspects of the disclosure relate to a carton for packaging one or more articles, a blank for forming the carton and a method of packaging articles. The carton may have at least one display window for presentation of an article therein. The carton comprises a plurality of panels forming walls of a tubular structure including a top wall, a first side wall, a base wall, and a second side wall. The carton comprises an end closure structure for partially closing an end of the carton. The end closure structure comprises a top end closure flap hingedly connected to the top wall. At least one side end closure flap is hinged to a corner panel by a first fold line. The corner panel is hinged to one of the first and second side walls by a second fold line.

12 Claims, 5 Drawing Sheets

(51) Int. Cl.
*B65D 5/48* (2006.01)
*B65D 5/02* (2006.01)
*B65D 5/50* (2006.01)

(52) U.S. Cl.
CPC ..... *B65D 2571/00185* (2013.01); *B65D 2571/00283* (2013.01); *B65D 2571/00308* (2013.01); *B65D 2571/00561* (2013.01); *B65D 2571/00753* (2013.01); *B65D 2571/00845* (2013.01); *B65D 2571/00907* (2013.01)

(56) References Cited

U.S. PATENT DOCUMENTS 3,687,020 A 8/1972 Cunningham et al.
3,895,713 A * 7/1975 Bunnell ..... B65D 25/00 206/427
3,977,518 A * 8/1976 Arneson ..... B65D 71/16 206/141
4,328,891 A * 5/1982 Elward ..... B65D 71/36 206/147
4,373,630 A * 2/1983 Oliff ..... B65D 71/16 206/148
4,463,852 A * 8/1984 Stone ..... B65D 71/0014 206/141
6,536,656 B2 * 3/2003 Auclair ..... B65D 71/36 206/427
7,690,502 B2 4/2010 Cuomo
8,347,591 B2 1/2013 Coltri-Johnson
2006/0157545 A1 * 7/2006 Auclair ..... B65D 71/20 229/103.2
2010/0264058 A1 10/2010 Krause
2012/0279897 A1 * 11/2012 Schmal ..... B65D 71/10 206/593
2015/0191284 A1 7/2015 Sutherland et al.
2015/0210414 A1 * 7/2015 Avril ..... B65B 21/00 198/401
2015/0266640 A1 * 9/2015 Thompson ..... B65D 71/16 206/428

FOREIGN PATENT DOCUMENTS

WO WO2013109849 A1 7/2013
WO WO2013169965 A1 11/2013

* cited by examiner

CARTON AND BLANK THEREFOR

CROSS-REFERENCE TO RELATED APPLICATIONS

This application claims the benefit of U.S. Provisional Patent Application No. 62/486,716, filed Apr. 18, 2017, which is incorporated herein by reference in its entirety.

TECHNICAL FIELD

The present invention relates to cartons and to blanks for forming the same. More specifically, but not exclusively, the invention relates to a carrier of the wrap-around type having a display window for presentation of an article therein.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is an object of the present disclosure to provide an article carrier having a display window for displaying an article within the carrier and wherein the orientation of the article can be adjusted whilst within the carrier.

The present invention seeks to provide an improvement in the field of cartons, typically formed from paperboard or the like.

SUMMARY

A first aspect of the invention provides a carton for packaging one or more articles. The carton comprises a plurality of panels forming walls of a tubular structure including a top wall, a first side wall, a base wall, and a second side wall. The carton further comprises a display window defined at least in the first side wall for display of at least one article. Atop opening is provided in at least the top wall for receiving an upper portion of said at least one article. A bottom opening is provided at least in the base wall to enable access to the said at least one article to raise and lower the elevation thereof such that the upper portion of said at least one article is movable upward and downward through the top opening.

Optionally, the top opening is defined in part in the top wall and in part in the first side wall.

Optionally, the top opening is struck from the top wall so as to be defined therein.

Optionally, the bottom opening comprises an assembly guide.

Optionally, the assembly guide is formed from a "V" shaped cutaway portion integrally formed with the bottom opening.

Optionally, the bottom opening is defined, at least in part, in a first base panel forming at least a portion of the base wall of the carton.

Optionally, the display window is defined at least in part by a displaceable flap hingedly connected to the first side wall.

Optionally, the displaceable flap is hingedly connected to the first side wall by a nonlinear fold line.

Optionally, the top wall is shorter in a longitudinal direction than the base wall.

Optionally, the top wall is shorter in a transverse direction than the base wall.

Optionally, the top opening is vertically aligned with the display window.

Optionally, the bottom opening is vertically aligned substantially with the display window.

A second aspect of the invention provides a carton for packaging one or more articles. The carton comprises a plurality of panels forming walls of a tubular structure including a first wall, a second wall opposing the first wall. The first and second wall are spaced apart by at least a third wall. The carton comprises a display window defined at least in the third wall for display of an article. A first opening is defined in at least the first wall for receiving a portion of said article. A second opening is defined in at least the second wall to access the article to translate the article such that said portion of the article passes through the first opening.

A third aspect of the invention provides a package comprising a carton and one or more articles disposed therein. The carton comprises a plurality of panels forming walls of a tubular structure including a top wall, a first side wall, a base wall, and a second side wall. A display window is defined in at least the first side wall for display of at least one article. A top opening is defined in at least the top wall for receiving an upper portion of said at least one article. A bottom opening is defined in at least the base wall to access said at least one article to raise and lower the elevation thereof such that the upper portion of said at least one article is movable upward and downward through the top opening.

Optionally, the at least one article comprises: a neck portion having a first dimension, for example diameter; a main body portion having second dimension, for example diameter, the second diameter being greater than the first diameter; and a transition region disposed between the neck portion and the main body portion; wherein the top opening is dimensioned so as allow the neck portion to pass therethrough and to inhibit at least the main body portion from passing through.

Optionally, the upper portion of said at least one article is disposed such that the top of the upper portion is disposed below the top opening and is not substantially received therein.

Optionally, the height of the at least one article is no greater than the height of the carton (defined by the distance between the top and base walls).

A fourth aspect of the invention provides a blank for forming a carton. The blank comprises a plurality of panels forming walls of a tubular structure including a top wall, a first side wall, a base wall, and a second side wall. The blank comprises a display window defined in at least the first side wall for display of at least one article. A top opening is defined at least the top wall for receiving an upper portion of said at least one article. A bottom opening is defined in at least the base wall to access said at least one article to raise and lower the elevation thereof such that the upper portion of said at least one article is movable upward and downward through the top opening.

A fifth aspect of the invention provides a blank for forming a carton. The blank comprises a plurality of panels for forming walls of a tubular structure, the plurality of panels including a first panel, a second panel and a third panel for spacing apart the first and second panels. The blank comprises a display window defined in at least the third panel for display of an article. A first opening is defined in at least the first panel for receiving a portion of said article and a second opening defined at least in the second panel to access the article to translate the article such that said portion of the article passes through the first opening.

Optionally, the display window defines a notional centre axis perpendicular to the fold lines the plurality of panels in series, and wherein the top opening is aligned with the display window along the notional centre axis.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
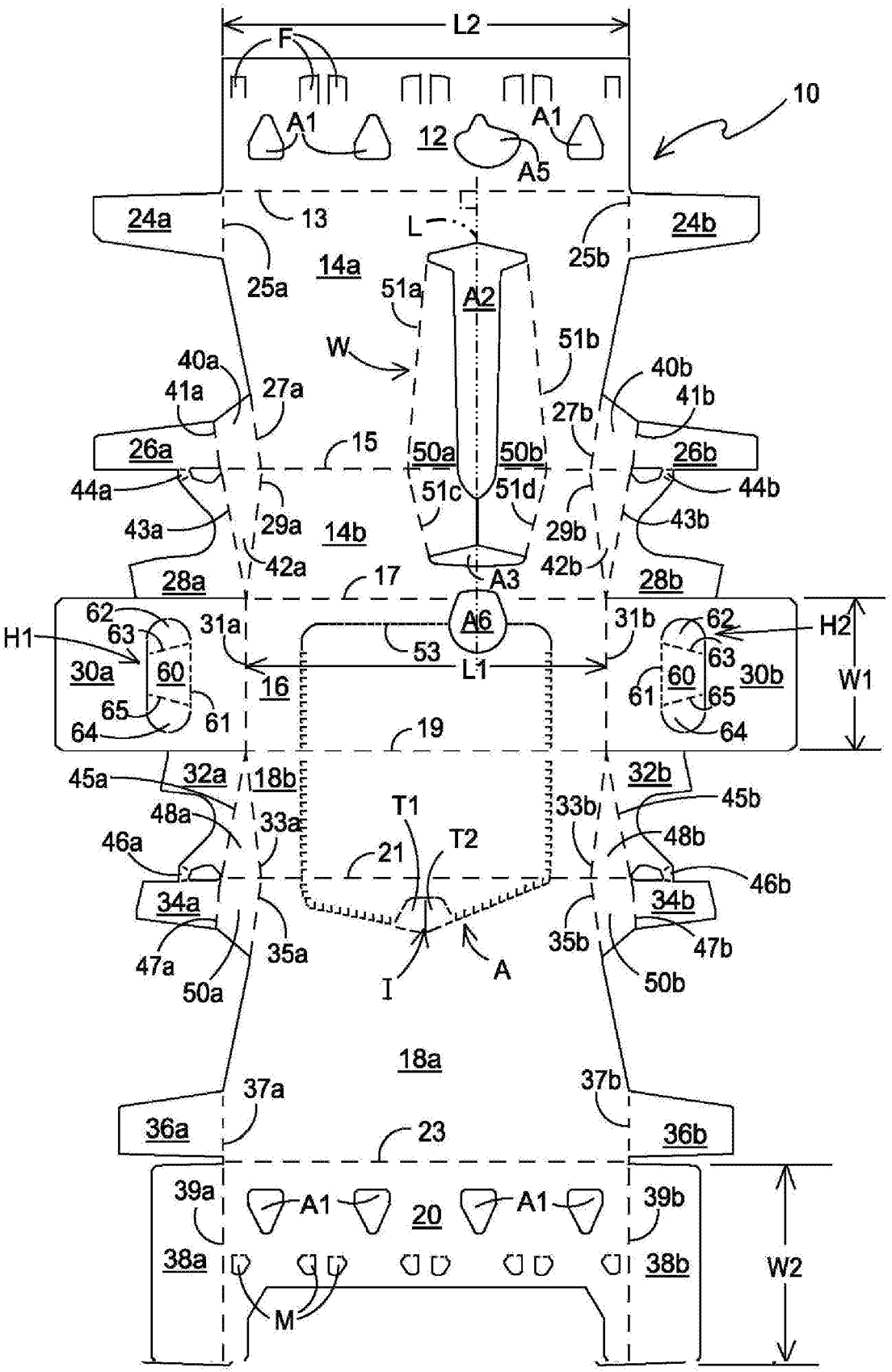
FIG. 1 is a plan view from above of a blank for forming a carton according to a first embodiment.
Figure 2:
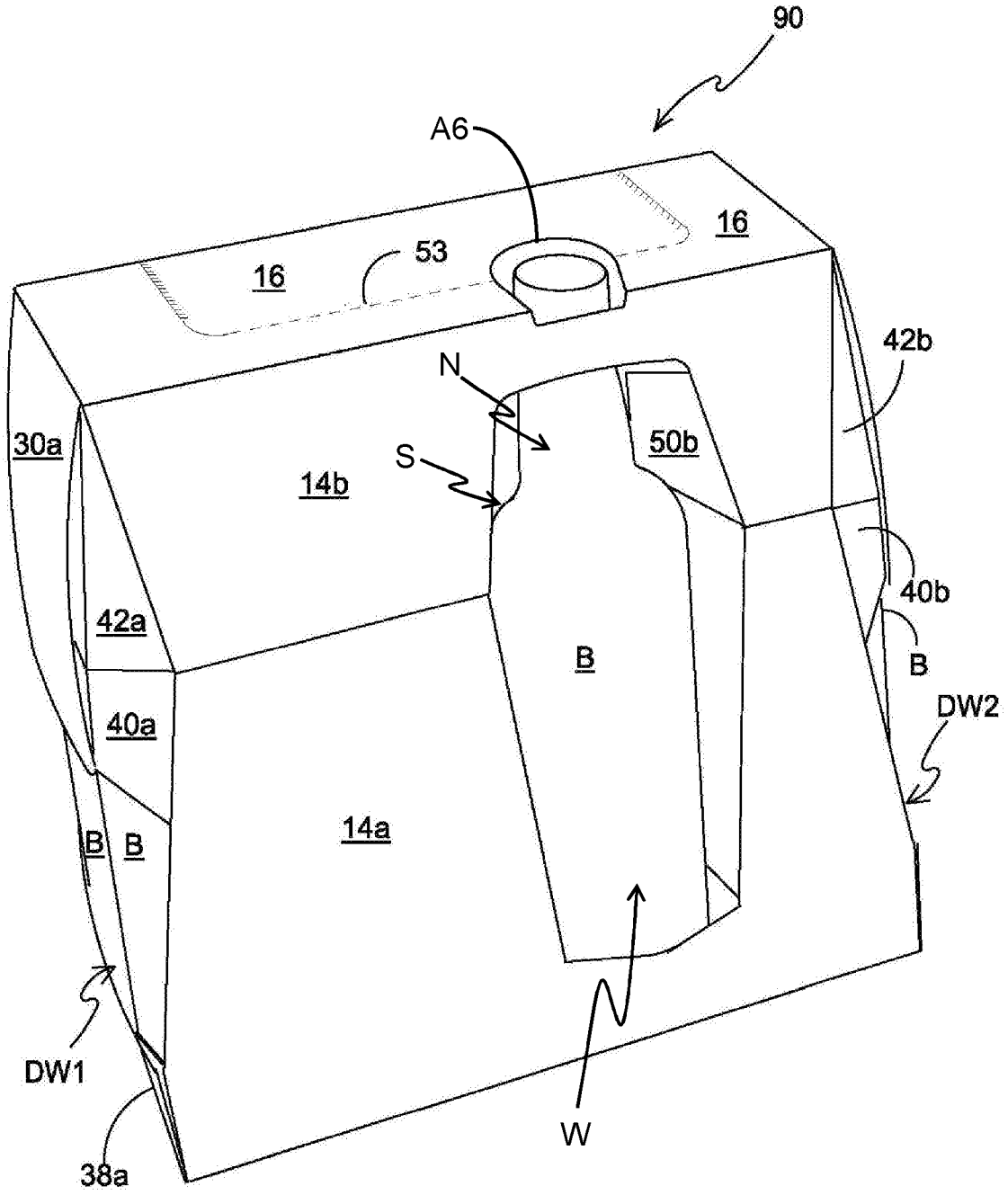
FIGS. 2 and 3 are perspective views from above of a carton formed from the blank of FIG. 1.

Referring to FIG. 1, there is shown a plan view of a blank 10 capable of forming a carton or carrier 90, as shown in FIGS. 2 to 5, for containing and carrying a group of primary products such as, but not limited to, bottles or cans, hereinafter referred to as articles B, as shown in FIG. 2. The blank 10 forms a secondary package for packaging at least one primary product container or package.

In the embodiments detailed herein, the terms "carton" and "carrier" refer, for the non-limiting purpose of illustrating the various features of the invention, to a container 90 for engaging and carrying articles B, such as primary product containers B. It is contemplated that the teachings of the invention can be applied to various product containers B, which may or may not be tapered and/or cylindrical. Exemplary containers include bottles B (for example metallic, glass or plastics bottles), cans (for example aluminium cans), tins, pouches, packets and the like.

The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or cartons described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiment, the blank 10 is configured to form a carton or carrier 90 for packaging an exemplary arrangement of exemplary articles B. In the embodiment illustrated the arrangement is a 4×2 matrix or array; in the illustrated embodiment two rows of four articles B are provided, and the articles B are 16 oz (approx. 473 ml) aluminium bottles. Alternatively, the blank 10 can be configured to form a carrier for packaging other types, number and size of articles B and/or for packaging articles B in a different arrangement or configuration.

The present invention relates generally to a carton 90 for packaging articles B which carton 90 comprises an article engaging arrangement for engaging an article B. The embodiments described herein further comprise a viewing window arrangement or display window W struck from a side wall 14*a*/14*b* of the carton 90. The window presents, for view a substantial portion of an article B contained within the carton 90, adjacent to that side wall 14*a*/14*b*. The embodiments described herein also comprise a viewing window arrangement or display window DW1, DW2 in at least one end wall.

Turning to FIG. 1, there is illustrated a blank 10 for forming a carton 90 according to a first embodiment. The blank 10 comprises a plurality of main panels 12, 14*a*, 14*b*, 16, 18*b*, 18*a*, 20 for forming a tubular structure. The plurality of main panels 12, 14*a*, 14*b*, 16, 18*b*, 18*a*, 20 comprises a first base panel 12, a first lower side panel 14*a*, a first upper side panel 14*b*, a top panel 16, a second upper side panel 18*b*, a second lower side panel 18*a* and a second base panel 20. The plurality of panels 12, 14*a*, 14*b*, 16, 18*b*, 18*a*, 20 may be arranged in a linear series hinged one to the next by corresponding fold lines 13, 15, 17, 19, 21, 23. The first upper side panel 14*b* and the first lower side panel 14*a* form a first side wall 14*a*/14*b* of a carton 90. The second upper side panel 18*b* and the second lower side panel 18*a* form a second side wall 18*a*/18*b* of a carton 90.

Figure 3:
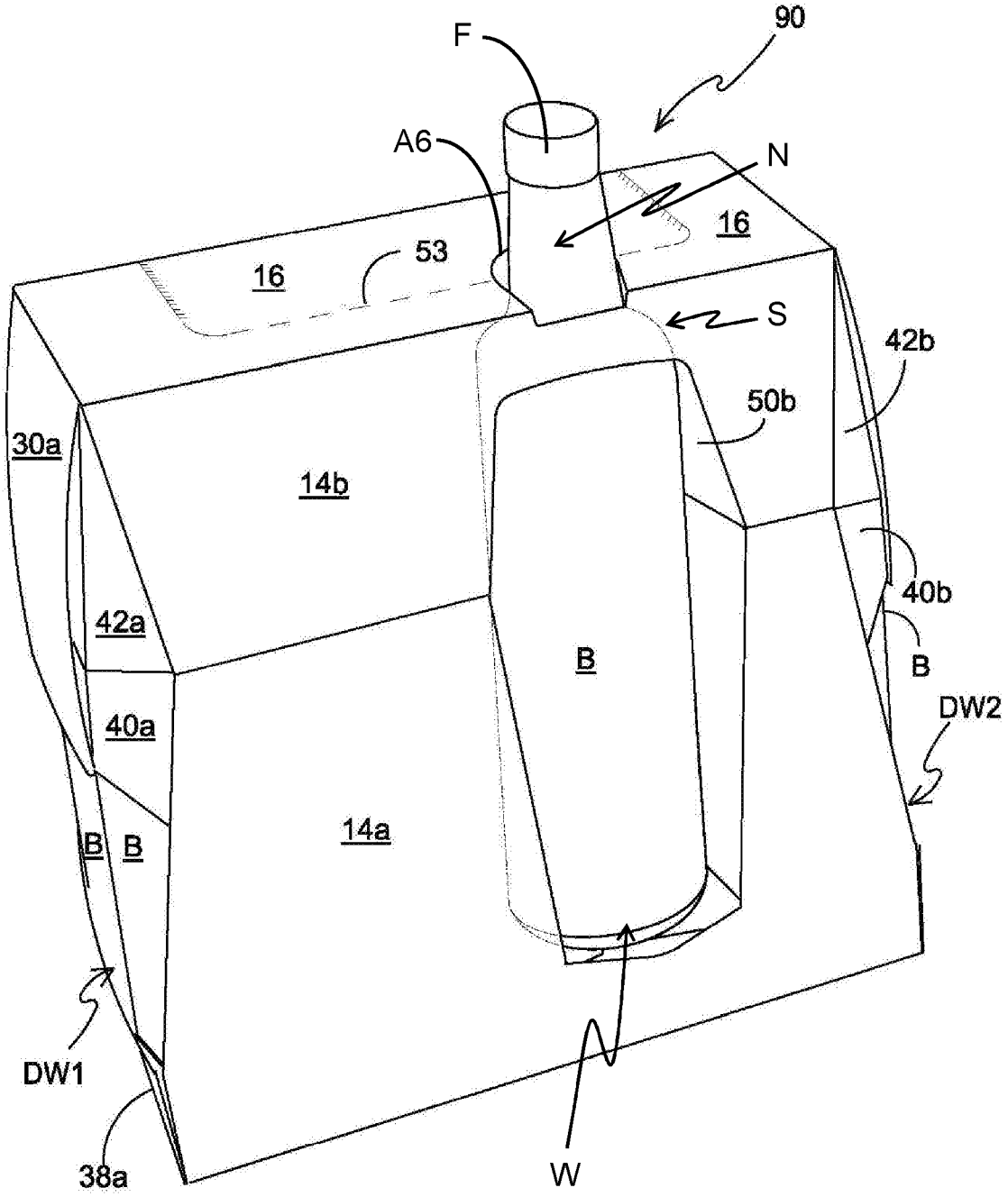
Figure 4:
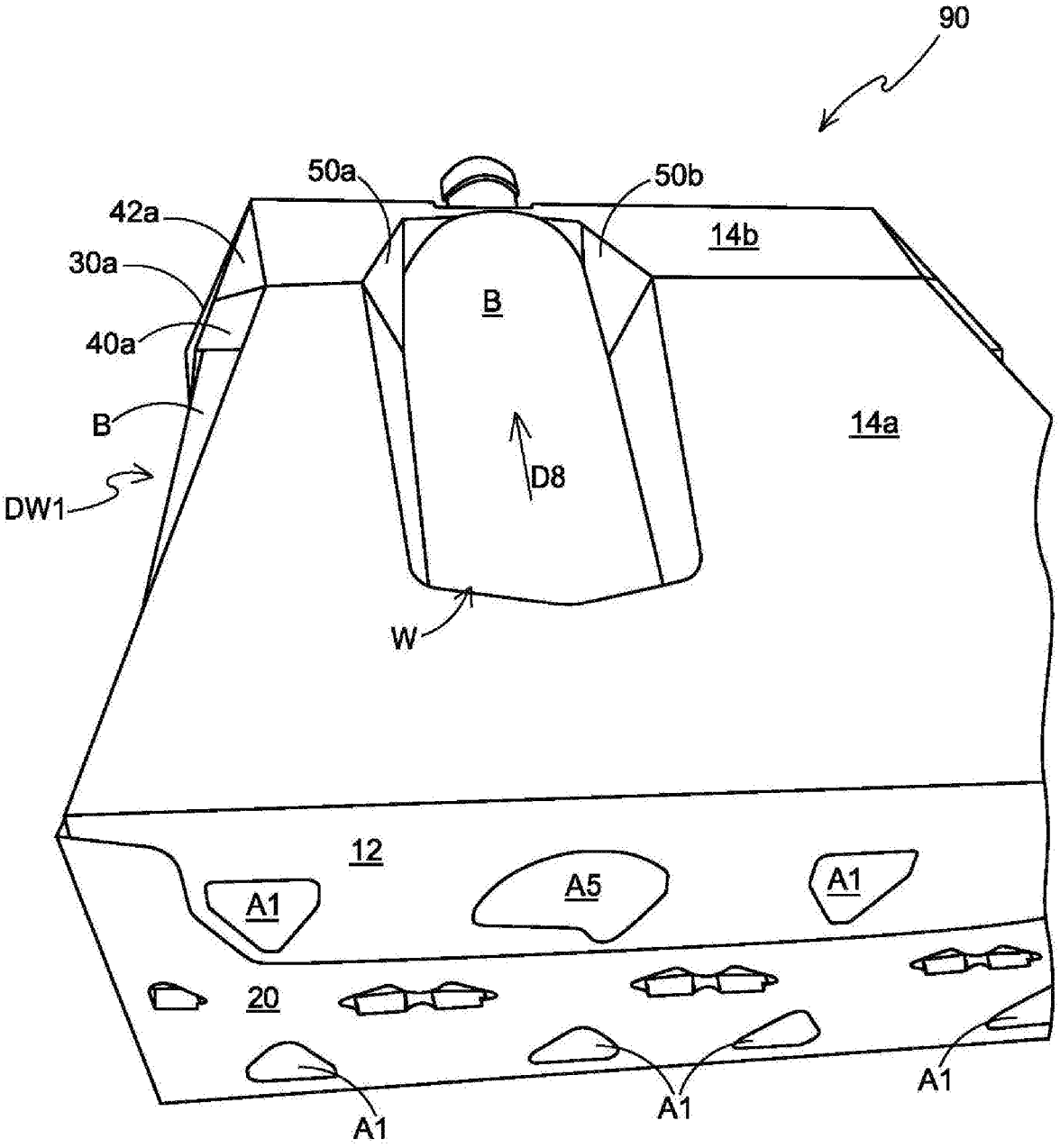
FIGS. 4 and 5 are further perspective views of the carton of FIG. 2 in which a displayed article has been manipulated within the carton such that its orientation is adjustable.

The blank 10 is foldable to form a package 90 as illustrated in FIGS. 2 to 4. The first and second base panels 12, 20 are engageable with one another in an overlapping relationship to form a composite base wall 12/20 of the carton 90. The blank 10 may comprise a complementary locking mechanism for securing the second base panel 20 to the first base panel 12. The first base panel 12 may comprise at least one first part F of the complementary locking mechanism. The second base panel 20 may comprise at least one second part M of the complementary locking mechanism. In the illustrated embodiment, the first base panel 12 comprises a plurality of female tabs F defining openings in the first base panel 12. The second base panel 20 comprises a plurality of male tabs M, the openings in the first base panel 12 being configured to receive a respective one of the male tabs M. The female tabs F are arranged to be displaced out of the first base panel 12 to form the opening and to bear against the male tabs M when received therein.

The first and second base panels 12, 20 may comprise at least one first aperture A1. In the illustrated embodiment, each of the first and second base panels 12, 20 comprises four first apertures A1. The first apertures A1 may be employed to facilitate construction of the carton 90. A packaging machine component may engage with the first apertures A1 to enable the plurality of panels 12, 14*a*, 14*b*, 16, 18*b*, 18*a*, 20 to be tightened about a group of articles B. The first apertures A1 may also be employed to facilitate alignment of the first and second base panels 12, 20 with respect to each other or to align the first part of the complementary locking mechanism with the second part of the complementary locking mechanism. The complementary locking mechanism illustrated and described is entirely optional.

The blank 10 comprises at least one first display window W for presentation of an article B.

Optionally, the blank 10 comprises a first display window W formed in each of the first upper and first lower side walls 14*b*, 14*a*.

The first display window W comprises an opening in each of the first upper and first lower side walls or panels 14*b*, 14*a*. The opening is defined in part by: a first displaceable tab or flap 50*a*; in part by a second displaceable tab or flap 50*b*; in part by a second aperture A2 struck in part from the first upper side wall 14*b* and the first lower side wall 14*a*; and in part by a third aperture A3 struck from the first upper side wall 14*b*. The first and second displaceable flaps 50*a*, 50*b* are separated from each other in part by the second aperture A2 and in part by a severable line in the form of a cutline. The third aperture A3 defines upper edges of each of the first and second displaceable flaps 50*a*, 50*b*. The cutline extends between the second aperture A2 and the third aperture A3. The first and second displaceable flaps 50*a*, 50*b* are hinged to the first lower side panel 14*a* by fold lines 51*a*, 51*b* respectively. The first and second displaceable flaps 50*a*, 50*b* are hinged to the first upper side panel 14*b* by fold lines 51*c*, 51*d* respectively. The fold line 51*a* is contiguously arranged with the fold line 51*c* and the fold line 51*b* is convergently arranged with respect to the fold line 51*d*. The fold line 51*a* and the fold line 51*c* define an oblique angle therebetween. The fold line 51*b* is contiguously arranged with the fold line 51*d* and the fold line 51*b* is convergently arranged with respect to the fold line 51*d*. The fold line 51*b* and the fold line 51*d* define an oblique angle therebetween.

The first and second displaceable flaps 50*a*, 50*b* are hingedly connected to the first upper and first lower side walls 14*b*, 14*a* and are positioned opposite to one another.

In this way the fold lines 51*a*, 51*b*, 51*c*, 51*d*, in the illustrated embodiment, are non-linear hinged connections. In other embodiments the fold lines may be curvilinear or arcuate or may be comprised of two or more linear portions arranged contiguously and divergently with respect to each other.

When the tabs 50*a*, 50*b* are displaced to display an article B as shown in FIG. 2, the non-linear hinged connection increases or encourages the tendency of the displaceable tabs 50*a*, 50*b* to return to their original, unfolded, planar position. In this way the tabs 50*a*, 50*b*, when displaced, are biased towards the article B displayed within the window W. The tabs 50*a*, 50*b* form a frame about the displayed article B and may at least partially separate the displayed article B from adjacent articles B in the row of articles B proximate the first side panel 14*a*/14*b*. The tabs 50*a*, 50*b* may at least partially conceal aforesaid adjacent articles B.

The blank 10 comprises at least one end closure structure for at least partially closing an end of a tubular structure defined by the plurality of panels 12, 14*a*, 14*b*, 16, 18*b*, 18*a*, 20.

In the illustrated embodiment an end closure structure is provided for partially closing each end of the tubular structure.

Each of the end closure structures comprises a second display window DW1, DW2 for the display of one or more articles B disposed adjacent thereto. In other embodiments, one of the second display windows may be omitted such that a display window is provided at only one end of the tubular structure, in still other embodiments both the second display windows DW1, DW2 may be omitted.

The blank 10 comprises a first end closure structure comprising a plurality of end closure panels 24*a*, 26*a*, 28*a*, 30*a*, 32*a*, 34*a*, 36*a*, 38*a*, 40*a*, 42*a*, 44*a*, 46*a*, 48*a*, 50*a*.

The first end closure structure comprises a top end closure flap 30*a*, hingedly connected to the top panel 16 by a fold line 31*a*. A first upper end closure flap 28*a* is hingedly connected to a first upper corner panel 42*a* by a fold line 43*a*. The first upper corner panel 42*a* is hingedly connected to the first upper side panel 14*b* by a fold line 29*a*. A second upper end closure flap 32*a* is hingedly connected to a second upper corner panel 48*a* by a fold line 45*a*, the second upper corner panel 48*a* is hingedly connected to the second upper side panel 18*b* by a fold line 33*a*.

Optionally, the first end closure structure comprises a first intermediate side end closure flap 26*a* hingedly connected to a first lower corner panel 40*a* by a fold line 41*a*; the first lower corner panel 40*a* is hingedly connected to the first lower side panel 14*a* by a fold line 27*a*. Optionally, the first end closure structure comprises a second intermediate side end closure flap 34*a* hingedly connected to a second lower corner panel 50*a* by a fold line 47*a*; the second lower corner panel 50*a* is hingedly connected to the second lower side panel 18*a* by a fold line 35*a*.

The first lower corner panel 40*a* may be hingedly connected to the first upper corner panel 42*a* by a fold line. The fold line may be contiguously arranged with the fold line 15 so as to be a collinear extension thereof.

The second lower corner panel 50*a* may be hingedly connected to the second upper corner panel 48*a* by a fold line. The fold line may be contiguously arranged with the fold line 21 so as to be a collinear extension thereof.

The first intermediate side end closure flap 26*a* may be coupled to the first upper side end closure flap 28*a* by a first web panel 44*a*. An aperture may be provided between the web panel 44*a* and the first upper corner panel 42*a* to separate a portion of the first upper side end closure flap 28*a* from a portion of the first intermediate side end closure flap 26*a*.

The second intermediate side end closure flap 34*a* may be coupled to the second upper side end closure flap 32*a* by a second web panel 46*a*. An aperture may be provided between the web panel 46*a* and the second upper corner panel 48*a* to separate a portion of the second upper side end closure flap 32*a* from a portion of the second intermediate side end closure flap 34*a*.

Optionally, the first end closure structure comprises a first lower side end closure flap 24*a*, hingedly connected to the first lower side panel 14*a* by a hinged connection in the form of a fold line 25*a*. Optionally, a second lower side end closure flap 36*a* is hinged to the second lower side panel 18*a* by a hinged connection in the form of a fold line 37*a*. Optionally, a bottom end closure flap 38*a* is hinged to the second base panel 20 by hinged connection in the form of a fold line 39*a*. The first lower side end closure flap 24*a*, second lower side end closure flap 36*a* and bottom end closure flap 38*a* are arranged to partially close a lower region of an open end of the tubular structure.

The blank 10 comprises a second end closure structure comprising a plurality of end closure panels 24*b*, 26*b*, 28*b*, 30*b*, 32*b*, 34*b*, 36*b*, 38*b*, 40*b*, 42*b*, 44*b*, 46*b*, 48*b*, 50*b*. The second end closure structure is substantially the same in construction as the first end closure structure and will not be described in further detail.

Optionally, the blank 10 comprises a carrying handle structure H1, H2 in each of the top end closure flaps 30*a*, 30*b*. The carrying handle structures H1, H2 may be employed by a user to carry the carton 90. The first top end closure flap 30*a* comprises a first carrying handle structure H1 having a first handle opening defined at least in part by a handle flap 60 struck from the first top end closure flap 30*a*. The handle flap 60 is hinged to the first top end closure flap 30*a* by a hinged connection in the form of a fold line 61. The handle flap 60 comprises a pair of fold lines 63, 65 extending from the fold line 61 to an opposing side edge of the handle flap 60 so as to define a pair of foldable end portions 62, 64. The pair of fold lines are arranged so as to diverge towards the fold line 61. The second top end closure flap 30*b* comprises a second carrying handle structure H2 which is substantially the same in construction as the first carrying handle structure H1 and will not be described in further detail.

Optionally, the blank 10 comprises a dispensing or access feature A for facilitating access to the contents of the carton 90. The access feature A comprises an access panel struck in part from the top panel 16, in part from the second upper side panel 18*b*, and in part from the second lower side panel 18*a*. The access panel A is defined by a weakened line of severance 53 formed as a continuous loop such that the access panel A is at least partially severable from the carton 90. The access feature A may comprise a tear initiation feature I comprising a pair of tabs T1, T2 hingedly connected to the second lower side panel 18*a* by respective fold lines and defined by a outline interrupted by connecting portions or nicks so as to be readily severable. The tear initiation feature I defines a finger opening to enable engagement with the access panel A for removal thereof.

The first and second upper end closure flaps 28*a*, 32*a* may comprise a recessed or contoured free side edge opposing the respective hinged connection 43*a*, 45*a* to the first or second upper corner panel 42*a*, 48*a*. The contoured free side edges of the first and second upper end closure flaps 28*a*, 32*a* are shaped to facilitate the handle flap 60 being folded inwardly of the carton 90. The upper end closure flaps 28*b*, 32*b* of the second end closure structure may be similarly arranged.

The first lower corner panel 40*a* comprises a first lower free end edge opposite the hinged connection (when present) to the first upper corner panel 42*a*. The second lower corner panel 50*a* comprises a second lower free end edge opposite the hinged connection (when present) to the second upper corner panel 48*a*.

The first lower corner panel 40*a* terminates at the first lower free end edge. The first lower free end edge is distal from the first lower side end closure flap 24*a*, such that the first lower side panel 14*a* comprises a free edge portion, that is to say a portion of the side edge which is free from any hinged connection to the panels of the first side end closure structure.

The second lower corner panel 50*a* terminates at the second lower free end edge. The second lower free end edge is distal from the second lower side end closure flap 36*a*, such that the second lower side panel 18*a* comprises a free edge portion, that is to say a portion of a side edge which is free from any hinged connection to the panels of the second side end closure structure.

In embodiments where the first and second lower corner panels 40*a*, 50*a* and the first and second intermediate end closure flaps 26*a*, 34*a* are omitted, the first and second free lower edges are provided by the first and second upper corner panels 42*a*, 48*a*.

The corner panels 40*b*, 42*b*, 48*b*, 50*b* of the second end closure structure are similarly arranged to those of the first end closure structure.

The top panel 16 comprises a first length dimension $L_1$ extending between fold lines 31*a*, 31*b*. The first and second base panels 12, 20 comprise a second length dimension $L_2$ extending between free end edges of the first base panel 12 or between fold lines 39*a*, 39*b*. The second length dimension $L_2$ may be greater than the first length dimension $L_1$.

The top panel 16 comprises a first width dimension $W_1$ extending between fold lines 17, 19. The second base panel 20 comprises a second width dimension $W_2$. The second width dimension $W_2$ may be greater than the first width dimension $W_1$. In some embodiments, the second width dimension $W_2$ may be defined by both the first and second base panels 12, 20, and may be equivalent to the sum of the widths of the first and second base panels 12, 20 minus the width of a region of overlap between the first and second base panels 12, 20.

The blank 10 comprises an orientation adjustment device for enabling the orientation of an article B.

The orientation adjustment device is arranged such that the article B displayed in the first display window W in the first side wall 14*a*/14*b* can be controlled or adjusted. It will be appreciated that the orientation adjustment device may be located such that one or both articles B presented in the second display windows DW1, DW2 in the end walls of the carton 90 can be controlled or adjusted.

The orientation adjustment device comprises first cutaway or opening in the form of a bottom opening A5 provided in at least one of the first and second base panels 12, 20. In the illustrated embodiment the bottom opening A5 is provided in the first base panel 12.

In other embodiments the bottom opening A5 may be provided in the second base panel 20 or in part in each of the first and second base panels 12, 20.

The bottom opening A5 is arranged to be in vertical registry with the article B which is disposed in the first display window W.

In the illustrated embodiment, the bottom opening A5 is arranged to be vertically aligned substantially with the display window W.

The bottom opening A5 may be shaped so as to comprise a "V" or "U" shaped cutaway portion which provides an alignment or assembly guide. This cutaway portion may be engaged by a tool 80 (see FIG. 5), for example of a packaging machine. The cutaway portion may facilitate alignment of the first base panel 12 with the second base panel 20 when the carton 90 is assembled about a group of articles B. Additionally or alternatively the cutaway portion may facilitate tightening or wrapping of the carton 90 about the group of articles B. It may facilitate pulling the first base panel 12 towards the second side panel 18*a*/18*b* so as to increase the degree of overlap between the first and second base panels 12, 20 such that the complementary locking mechanism may be employed.

The orientation adjustment device comprises a second cutaway or opening in the form of a top opening A6 provided at least in part in the top panel 16. In the embodiment of FIG. 1 the top opening A6 is provided in part in the top panel 16 and in part in the first upper side panel 14*b*. Extending the aperture A6 into the first upper side panel 14*b* may facilitate folding the top panel 16 with respect to the first upper side panel 14*b* along the fold line 17.

In other embodiments, the top opening A6 may be provided solely in the top panel 16, so as to be struck from only material forming the top panel 16. Such an arrangement may be advantageous when the article B is returned or lowered to a rest position within the interior chamber of the carton 90.

In such alternative embodiments, a front or outer edge of the top opening A6 is provided by the top panel 16 and therefore is oriented horizontally or perpendicularly with respect to direction of travel of the article B as it moves, or descends, into the carton 90. This may reduce the likelihood of a portion of the article B, such as a flange or cap or other closure, from being caught or snagged upon material defining an edge of the top opening A6.

The top opening A6 is arranged to be in vertical registry with the upper end of the article B which is disposed in the display window W. The top opening A6 is dimensioned such that an upper portion of said article B can pass through the top panel 16.

The top opening A6 is arranged to be vertically aligned with the first display window W.

Figure 5:
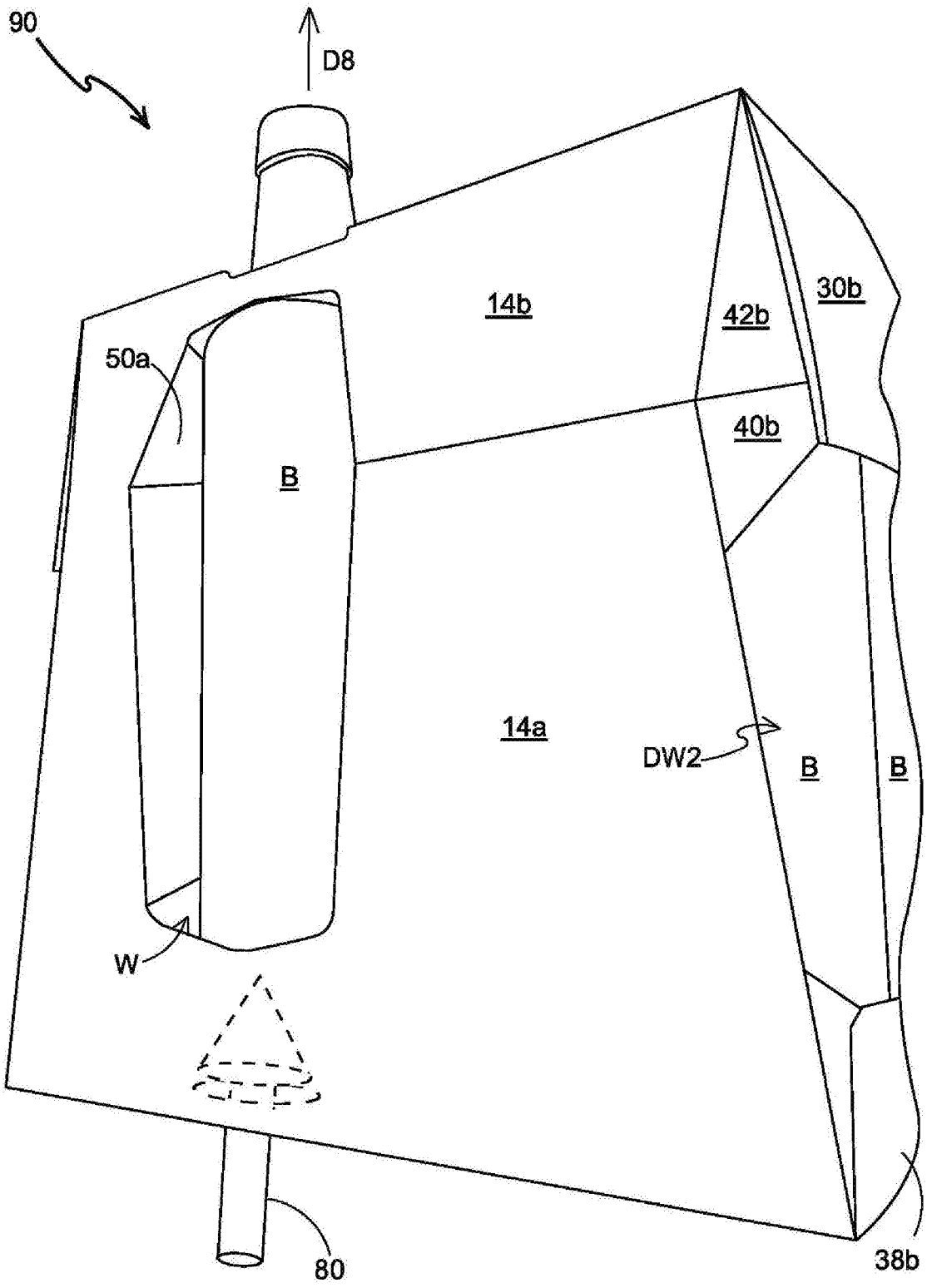

The top opening A6 may be dimensioned so as to be smaller than a shoulder portion of the article B. In this way an upper end portion of the article B may pass through the top opening A6 but is prevented from being fully withdrawn through the top opening A6. When the article B is a bottle, the "finish" F, and at least some of the "neck" N, may be positioned externally of the carton 90. The "shoulder" S, "body" and "heel" of the bottle, being retained within the carton 90, as shown in FIGS. 3 to 5.

In embodiments having a dispensing or access feature A the top opening A6 may interrupt the weakened line of severance 53. The top opening A6 may serve to facilitate removal of the access panel The first display window W defines a notional centre axis (as indicated by dot-dot-dash line L in FIG. 1) perpendicular to the fold lines 13, 15, 17, 19, 21, 23 which hingedly connect the plurality of panels 12, 14*a*, 14*b*, 16, 18*b*, 18*a*, 20 in series. The blank 10 is arranged such that the top opening A6 is aligned with the first display window W along the notional centre axis.

Turning to the construction of the carton 90 as illustrated in FIGS. 2 to 4, the carton 90 can be formed by a series of sequential folding operations in a straight line machine so that the carton 90 is not required to be rotated or inverted to complete its construction. The folding process is not limited to that described below and may be altered according to particular manufacturing requirements.

A group of articles B is assembled; in the preferred embodiment eight articles B are arranged in a 4×2 array. The top panel 16 of the blank 10 is disposed above the group of articles B to provide a top wall 16 of the carton 90.

The window panels 50*a*, 50*b* are folded inwardly of the carton 90 either prior to or simultaneously with the first and second side walls 14*a*/14*b*, 18*a*/18*b* being folded about the fold lines 17, 19 so as to be disposed on opposing sides of the group of articles B. The window panels 50*a*, 50*b* are disposed such that they are interposed between a pair of adjacent articles B. Folding the window panels 50*a*, 50*b* in this manner warps the corresponding one of the first or second side walls 14*a*/14*b*, 18*a*/18*b* to which they are attached due to the non-linear nature of the fold lines 51*a*, 51*b*, 51*c*, 51*d* connecting the window panels 50*a*, 50*a* to the first side wall 14*a*/14*b*. The warping of the first side wall 14*a*/14*b* urges the window panels 50*a*, 50*b* against the article B.

Once the first and second sidewalls 14*a*/14*b*, 18*a*/18*b* are folded about the opposing sides of the group of articles B; the first base panel 12 is folded about the fold line 13 so as to be disposed adjacent the base of the group of articles B. The second base panel 20 is then folded about the fold line 23 so as to be in at least partial overlapping relationship with the first base panel 12. The first and second base panels 12, 20 are secured together. Each of the male tabs M is displaced inwardly out of the plane of the second base panel 20. In so doing, each of the female tabs F is displaced inwardly creating a corresponding opening in the first base panel. The male tabs M are received in respective ones of the openings so as to lock the first and second base panels 12, 20 together. In this way a tubular structure is formed about the group of articles B.

In some embodiments, the blank 10 may be formed into a tubular structure and subsequently loaded with articles B through at least one open end thereof.

The first and second end closure structures are folded about the open ends of the tubular structure. The folding sequence for each of the first and second end closure structures is substantially the same and will be described in more detail by reference to the first end closure structure only.

The first and second upper side end closure flaps 28*a*, 32*a* and the first and second upper corner panels 42*a*, 48*a* are folded about the fold lines 29*a*, 33*a*, 43*a*, 45*a* so as to partially close a first open end of the tubular structure.

The first and second intermediate side end closure flaps 26*a*, 34*a* and the first and second lower corner panels 40*a*, 50*a*, when present, are also folded, about the fold lines 27*a*, 35*a*, 41*a*, 47*a*.

The first upper side end closure flap 28*a* may be secured to the second upper side end closure flap 32*a*. In some embodiments the first and second upper side end closure flaps 28*a*, 32*a* may be dimensioned so as to be arranged in an at least partial overlapping arrangement. Glue or other adhesive treatment may be applied to one of the first and second upper side end closure flaps 28*a*, 32*a* so as to secure them together. Similarly, the first intermediate side end closure flap 26*a* may be secured to the second intermediate side end closure flap 34*a*. In some embodiments the first and second intermediate side end closure flaps 26*a*, 34*a* may be dimensioned so as to be arranged in an at least partial overlapping arrangement. Glue or other adhesive treatment may be applied to one of the first and second intermediate side end closure flaps 26*a*, 34*a* so as to secure them together.

The top end closure flap 30*a* is folded about fold line 31*a* so as to be brought into face contacting relationship with the first and second upper side end closure flaps 28*a*, 32*a* and optionally with the first and second intermediate side end closure flaps 26*a*, 34*a*. Glue or other adhesive treatment may be applied to first and second upper side end closure flaps 28*a*, 32*a*, the first and second intermediate side end closure flaps 26*a*, 34*a* or the top end closure flap 30*a* so as to secure them together.

The first and second lower side end closure flaps 24*a*, 36*a*, when present, are folded about the fold lines 25*a*, 37*a*. The first lower side end closure flap 24*a* may be secured to the second lower side end closure flap 36*a*. In some embodiments the first and second lower side end closure flaps 24*a*, 36*a* may be dimensioned so as to be arranged in an at least partial overlapping arrangement. Glue or other adhesive treatment may be applied to one of the first and second lower side end closure flaps 24*a*, 36*a* so as to secure them together.

The bottom end closure flap 38*a* is folded about fold line 39*a* so as to be brought up into face contacting relationship with the first and second lower side end closure flaps 24*a*, 36*a*.

FIGS. 2 to 5 illustrate a carton 90 in which a first side wall 14*a*/14*b* comprises a first display window W exposing to view an article B. The pair of displaceable flaps 50*a*, 50*b* form a frame about the article B, best shown in FIG. 2. The article B is shown in a first rest position in FIG. 2.

The article B presented in the first display window W in the first side wall 14*a*/14*b* is moveable or translatable, as indicated by direction arrow D8, within the assembled carton 90. A finger or tool 80 can be inserted through the base wall 12/20 formed by the first and second base panels 12, 20, as shown in FIG. 5.

When the article B is moved an upper portion passes through the top opening A6 and is external of the carton 90 as shown in FIGS. 3 to 5. In this second deployed position the article B is readily accessible. The orientation of the article B may be adjusted in the deployed position, upon reaching the desired orientation the article B may be returned to the rest position.

The carton 90 and the articles B form a package in which the upper portion of the article B is arranged in a rest position such that the top of the upper portion is disposed below the top opening A6 and is not substantially received therein.

The package or carton 90 is arranged such that the height of the article B is no greater than the height of the carton 90, wherein the height of the carton 90 is defined by the distance between the top and base panel 16, 12/20).

The carton 90 may comprise at least one second display window DW1, DW2 defined in or by an end wall. The second display window DW1, DW2 exposes to view a pair of endmost articles B, particularly a label or other indicia printed or otherwise displayed on a lower or main body portion of the articles B. The articles B comprise a main body and a neck portion disposed above the main body; the neck portion comprises a smaller dimension or diameter than the main body. A shoulder region provides a transition between the main body and the neck portion. The top end closure flap 30*a* is configured to obscure from view at least the neck portion. In some embodiments, the shoulder region or an upper portion of the main body or both may be obscured from view by the top end closure flap 30*a*, 30*b*.

The second display window DW1, DW2 is defined in part by free side edge portions of each of the first and second side walls 14*a*, 18*a*.

In this way branding or other indicia provided upon the articles B may be displayed through the first display window W or the second display window DW1, DW2. The articles B may be arranged in a desired orientation. The displaceable flaps 50*a*, 50*b* may bear against an article B so as to prevent or inhibit rotation of the article B away from the desired orientation.

The first and second end closure structures may be tightened so as to bear against the endmost articles B so as to prevent or inhibit rotation of the articles B away from a predefined orientation. For example, portions of the first or second corner panels 40*a*/42*a*, 48*a*/50*a*, such as but not limited to a lower free edge, may bear against a respective one the endmost articles B. The first and second upper side end closure flaps 28*a*, 32*a* or the first and second intermediate side end closure flaps 26*a*, 34*a* may engage the endmost articles B, with frictional forces therebetween preventing or inhibiting rotation of the articles B.

The first and second upper side end closure panels 28*a*, 32*a* may be aligned with, or arranged to bear against, a cap or closure portion at an upper end of an adjacent article B.

The first and second intermediate side end closure panels 26*a*, 34*a* may be aligned with, or arranged to bear against, the shoulder portion or main body of an adjacent article B.

The present disclosure provides a carton 90 for packaging articles B; the carton 90 may have at least one display window for presentation of an article B therein. The carton 90 comprises a plurality of panels forming walls of a tubular structure including a top wall, a first side wall, a base wall, and a second side wall, optionally hingedly connected to each other in a linear series.

The carton 90 comprises an orientation adjustment device for enabling the orientation of an article B which is at least partially exposed to view through the display window. The orientation adjustment device comprises a first cutaway in the form of an aperture or opening in a first panel of the carton. The orientation adjustment device comprises a second cutaway in the form of an aperture or opening in a second panel of the carton 90, wherein the second panel opposes the first panel. The first panel may be a base panel and the second panel may be a top panel. The first cutaway is configured to allow access to a first end, optionally a base portion, of an article B. The first cutaway is configured to prevent the first end of the article B passing therethrough. The second cutaway configured to allow a second, opposing, end portion of the article (optionally a top or upper portion) of the article to pass through. The article B may comprise a shoulder or other transition region and a main body portion, the second cutaway is configured to prevent or inhibit the article from being fully withdrawn therethrough. The second cutaway is configured to be smaller in dimension than the transition region or the main body portion or both the transition region and the main body portion.

The carton 90 may comprise an end closure structure for partially closing an end of the carton. The end closure structure comprises a top end closure flap hingedly connected to the top panel, at least one side end closure flap hinged to a corner panel, and the corner panel hinged to one of the first and second side walls, wherein the at least one side end closure flap is arranged to be securable to the top end closure flap.

The corner panel may be hinged to said one of the first and second side walls by a non-linear fold line. The non-linear fold line may be configured such that the corner panel bows inwardly so as to be concave when viewed from a viewpoint external of the carton. Advantageously, this may form a biasing device for biasing the corner panel towards or against an adjacently disposed article.

The top wall of the carton may be shorter than the base wall in a longitudinal direction parallel to a tubular axis of the tubular structure formed by the plurality of main panels.

The top wall of the carton may be shorter than the base wall in a transverse direction perpendicular to the tubular axis of the tubular structure formed by the plurality of main panels.

The present disclosure further provides a method of packaging articles or a method of assembling a carton, in which the method enables the position of one or more articles, or the orientation of said one or more articles, or both the position and orientation of said one or more articles, to be adjusted and optionally secured or held whilst within the carton.

It can be appreciated that various changes may be made within the scope of the present invention. For example, the size and shape of the panels and apertures may be adjusted to accommodate articles of differing size or shape. In alternative embodiments the web panels 44*a*, 44*b*, 46*a*, 46*b* may be omitted. The apertures between the first and second upper side end closure panels 28*a*, 32*a* and the respective one of the first and second intermediate side end closure panels 26*a*, 34*a* may be omitted. In this way the first intermediate side end closure panel 26*a* becomes integrally formed with first upper side end closure panel 28*a* and may comprise a first handle recess for facilitating insertion of a user's hand. The second intermediate side end closure panel 34*a* becomes integrally formed with second upper side end closure panel 36*a* and may comprise a second handle recess for facilitating insertion of a user's hand. In such embodiments the fold line 43*a* may be collinear with the fold line 41*a*; similarly the fold line 45*a* may be collinear with the fold line 47*a*.

In some embodiments, the fold lines 15 and 17 and their respective extensions into the corner panels 40*a*/42*a*, 48*a*/50*a* may be omitted such that the first upper corner panel 42*a* is integral with the first lower corner panel 40*a*; the second upper corner panel 48*a* is integral with the second lower corner panel 50*a*.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

It should also be understood that the carton of the invention may include two or more first display windows, such as shown in the drawings at "W", associated with their respective pairs of top and bottom openings. In that case, each pair of upper and lower openings is located directly above and below the respective display window such that the upper and lower openings of each pair are vertically aligned with the respective display window.

The invention claimed is:

1. A package comprising a carton and a plurality of articles disposed therein, the carton comprising a plurality of panels forming walls of a tubular structure including a top wall, a first side wall, a base wall, and a second side wall, the carton comprises a display window defined at least in the first side wall for display of a display article disposed immediately adjacent to the display window, the display article being at least partially visible through the display window from an exterior of the carton, a top opening defined, at least, in the top wall for receiving an upper portion of said display article and a bottom opening defined at least in the base wall to access said display article at a first position in which the display article is disposed entirely within an interior of the carton and a second position in which an upper portion of said display article extends through the top opening, wherein the display article comprises a neck portion having a first diameter, a main body portion having second diameter, the second diameter being greater than the first diameter and a transition region disposed between the neck portion and the main body portion, wherein the top opening is dimensioned so as to allow at least a portion of the neck portion to pass therethrough and to inhibit at least the main body portion from passing through, wherein the top wall is otherwise free of any openings positioned and dimensioned so as to allow a neck portion of any one of the plurality of articles other than the display article to pass therethrough and to inhibit at least a main body portion of said any one of the plurality of articles other than the display article from passing through.

2. A package according to claim 1 wherein the top opening is defined in part in the top wall and in part in the first side wall.

3. A package according to claim 1 wherein the top opening is struck from the top wall so as to be defined therein.

4. A package according to claim 1 wherein the bottom opening comprises an assembly guide.

5. A package according to claim 4 wherein the assembly guide is formed from a "V" shaped cutaway portion integrally formed with the bottom opening.

6. A package according to claim 1 wherein the bottom opening is defined, at least in part, in a first base panel forming at least a portion of the base wall of the carton.

7. A package according to claim 1 wherein the display window is defined at least in part by a displaceable flap hingedly connected to the first side wall.

8. A package according to claim 7 wherein the displaceable flap is hingedly connected to the first side wall by a nonlinear fold line.

9. A package according to claim 1 wherein the top wall is shorter in a longitudinal direction than the base wall.

10. A package according to claim 1 wherein the top wall is shorter in a transverse direction than the base wall.

11. A package according to claim 1 wherein the top opening is vertically aligned with the display window.

12. A package according to claim 11 wherein the bottom opening is vertically aligned substantially with the display window.

* * * * *